US005104163A

United States Patent [19]

Palmer, Jr. et al.

[11] Patent Number: 5,104,163

[45] Date of Patent: Apr. 14, 1992

[54] DOUBLE SELF-LATCHING, DOUBLE-LOCKING GATE LATCH MECHANISM

[76] Inventors: Clem L. Palmer, Jr., c/o 5300 Hollister, Suite 230, Houston, Tex. 77040; Glenn M. Davis, 900 Michael Dr., Alvin, Tex. 77511

[21] Appl. No.: 743,199

[22] Filed: Aug. 9, 1991

[51] Int. Cl.[5] ..... E05C 1/06

[52] U.S. Cl. ..... 292/335; 292/341.17; 292/148; 292/59

[58] Field of Search ..... 292/341.15, 341.17, 292/335, 63, 67, 59, 68, 148

[56] References Cited

U.S. PATENT DOCUMENTS

| | | | |
|---|---|---|---|
| 1,733,847 | 10/1929 | Wilmot | 292/335 X |
| 1,774,330 | 8/1930 | Kaser | 292/335 |
| 2,078,572 | 4/1937 | Jacob | 292/68 |
| 3,263,351 | 8/1966 | Olson | 292/335 X |
| 3,891,253 | 6/1975 | Revell | 292/59 |

*Primary Examiner*—Richard E. Moore

[57] ABSTRACT

A double self-latching double-locking gate latch mechanism includes a first latch bracket for attachment to one gate member and supporting a rotatable latch element for movement between latched and unlatched positions and having a locking plate member at one end for registry with a locking element of the bracket each forming a lock opening to receive a padlock at the latched position of the rotatable latch element. At its opposite end the rotatable latch element defines a transversely oriented elongate head. A second latch bracket is provided for attachment to a second gate member and forms a latch chamber that receives an elongate latch slide having a bifurcated extremity forming an elongate slot of sufficient width for passage of the T-head therethrough when the rotatable latch element is at its unlatched position with the elongate head of the rotatable latch element oriented transversely of the elongate slot. At the latched position of the rotatable latch element the latch slide is linearly movable to a retracted position for unlocking. The latch slide is capable of being restrained at its retracted position until it is released by closing force for movement to its latched position by a compression spring. The rotatable latch element is urged toward its latched position by a torsion spring which provides self-latching capability upon closure of the gate.

15 Claims, 2 Drawing Sheets

FIG.1
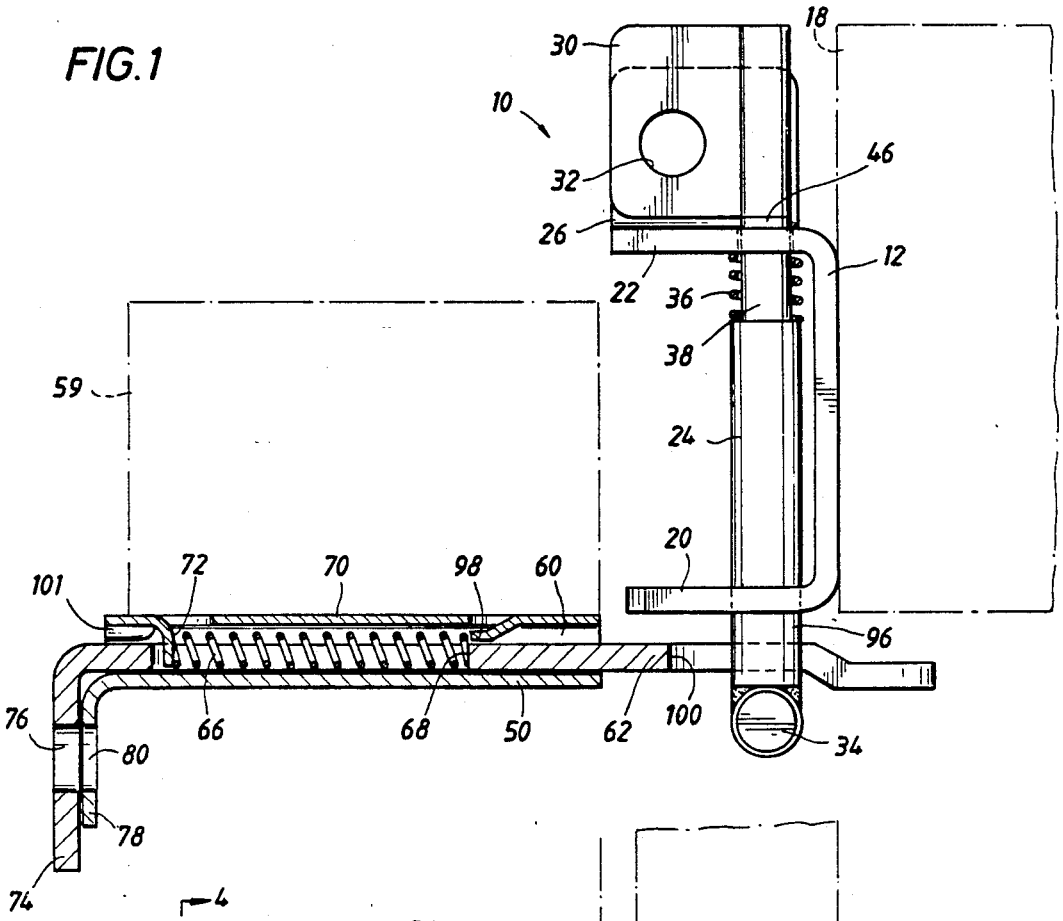
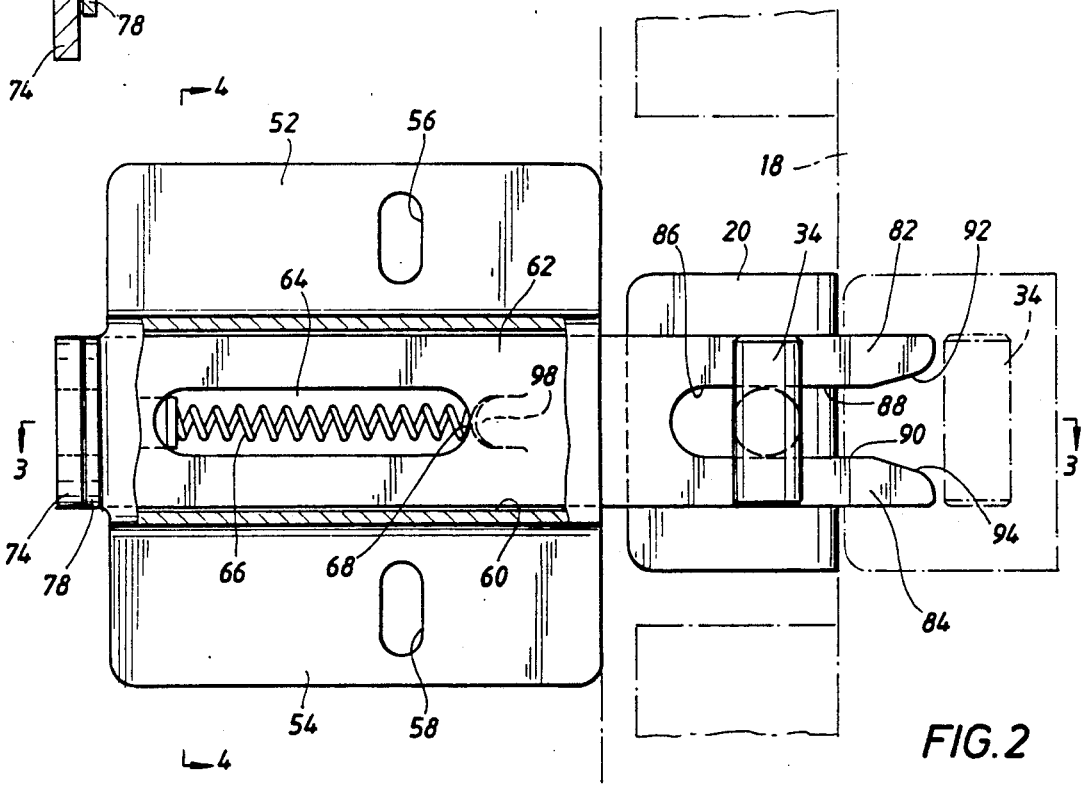
FIG.2

DOUBLE SELF-LATCHING, DOUBLE-LOCKING GATE LATCH MECHANISM

FIELD OF THE INVENTION

This invention relates generally to gate latch mechanisms such as are provided for locking and unlocking single or double outdoor gates. More particularly, the present invention is directed to a unique double self-latching, double locking gate latch mechanism for single and double gate assemblies and which is capable of being unlocked and released from either side thereof and which automatically latches upon gate closure.

BACKGROUND OF THE INVENTION

Most homes are provided with fencing systems to enclose all or a portion of the lot on which the home is situated. Where fencing is employed, it may be of the chain link type through which visibility is good or it may be of a solid wood type wherein visibility through the fence is prevented. fences are obviously provided for security reasons and in many cases are provided to protect children and other persons from any other hazardous environment that may be located on the premises. For example, many domestic facilities are constructed to include swimming pools, exotic gardens and the like, and in many cases contain dogs as pets or guards. Where any kind of hazardous environment is located on the premises, it is desirable to provide a security fence, especially in the case where the back yard of a home contains a swimming pool. Insurance codes and city and county laws often require the swimming pool to be fenced to prevent young children from being attracted to it and gaining unauthorized access to it.

Especially where wooden fences are employed, typically the fences are of sufficient height that one cannot see over them. Obviously, where fences are employed, security gates are also employed. Under circumstances where the gates are of the single type, the opposite portion of the fence contains a latch receptacle which is engageable by a corresponding latch mechanism on the gate. In the case of double gates such as are frequently utilized to form a gate closure for driveways, a pair of gates are each pivoted to sections of the fence and are then secured together at the central portion thereof by a latch mechanism. In all cases known at the present time, gate mechanisms that are commercially available are intended to be installed on the gate assembly such that they are accessible from one side only. If the gate and fence are of the solid type and one wishes to pass through the gate from the opposite direction with a single latch on the opposite side, the person cannot unlatch and pass through the gate and thus must pass through the house or around the opposite side of the fence in order to gain access to the latch. It is therefore desirable to provide a latch mechanism that is capable of being unlocked and opened from either side of the gate mechanism. It is also desirable to provide a latch mechanism that is capable of being utilized with both single and double gate assemblies without any significant alteration thereof. It is also desirable to provide a double self-latching double-locking gate latch mechanism that automatically self-latches regardless of the side from which it is opened.

SUMMARY OF THE INVENTION

According to the principles of the present invention, a double self-latching double-locking gate latch mechanism is provided which may be installed on single and double gate assemblies and which is capable of being unlocked and opened from either side thereof and which is also capable of self-latching upon closure of the gate regardless of the side from which it is unlatched and opened The latch mechanism of the present invention incorporates a first latch bracket which is adapted to be abutted to gate structure and secured thereto by means of screws, bolts or the like. The first latch bracket is generally a U-shaped bracket having outwardly projecting flange portions that provide rotatable support for a rotatable latch element in the form of an elongate pin. The first latch bracket forms a laterally projecting locking plate having a lock opening therein that is adapted for padlock receiving registry with a like lock opening formed in a locking plate that projects laterally from one end of the rotatable latch element. At its opposite end the rotatable latch element is provided with an elongate transverse latch retainer which may be in the form of a T-head. A second latch bracket is provided which defines an elongate internal housing or chamber that provides guiding support for an elongate latch slide. The latch slide is provided with a bifurcated extremity forming an elongate slot of sufficient width to allow passage of the T-head therethrough when the rotatable latch element is at its unlatched position. In the latched position of the rotatable latch element the transverse T-head overlies the bifurcated extremity of the latch slide and permits lateral movement of the latch slide that occurs upon opening of the gate. At its opposite end the latch slide defines a transverse projection having a lock aperture which, at the extended or locked position of the latch slide, is disposed in registry with the lock opening of a transverse projection extending from the second latch bracket. At the extended or latch position of the latch slide the registering lock openings are capable of receiving the shackle of a padlock to secure the latch slide at its extended position.

The latch slide is movable to a retracted position against the force of a compression spring located within the latch chamber which urges the latch slide toward its latched position. The latch slide is also capable of being temporarily restrained at its retracted position by restraining interengagement between the latch slide and an internal projection within the second latch bracket. The internal projection engages a stop shoulder of the latch slide when the latch slide is disposed at an angulated position within the latch chamber. This self-latching feature permits automatic spring urged movement of the latch slide to its extended or locked position when its bifurcated extremity is subjected to lateral force that occurs upon gate closure.

The rotatable latch element is also provided with a self-latching feature which may conveniently take the form of a torsion spring which urges the rotatable latch element toward its latched position. The torsion spring automatically returns the rotatable latch element to its latched position upon release of the rotational unlatching force. In an alternative embodiment, when unlatched, the rotatable latch element can be subject to frictional resistance which restrains automatic rotation thereof to its latched position. This frictional resistance is overcome as the rotatable latch element is subjected to linear force upon gate closure thereby causing the torsion spring to automatically rotate the latch element to its latched position, thus providing for self latching upon gate closure.

The gate latch mechanism, therefore, requires two padlocks or other locking devices with shackles of the padlocks extending through registering lock openings presented at respective sides of the gate latch assembly or gate for securing the gate in latched position. Upon removal of either of the padlocks, or locking devices, the gate assembly is capable of being opened even though the padlock on the opposite side of the gate remains locked. Thus, the gate assembly may be unlocked and opened from either side thereof. Upon closure of the gate from either side, the force of closure induces automatic latching of the latch mechanism.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is a partial sectional view in plan, representing a double self-latching double-locking gate mechanism that is constructed in accordance with the principles of the present invention.

FIG. 2 is a front elevational view of the gate latch mechanism of FIG. 1 with parts thereof broken away and shown in section.

FIG. 3 is a section taken along line 3—3 of FIG. 2 and showing the latch slide thereof at its retracted or unlocked position.

FIG. 4 is a sectional view taken along line 4—4 of FIG. 2 and illustrating the gate latch mechanism in its latched position similar to FIG. 2.

FIG. 5 is a partial sectional view similar to FIG. 1 and illustrating a modified embodiment of this invention.

DETAILED DESCRIPTION OF PREFERRED EMBODIMENT

Figure 5:
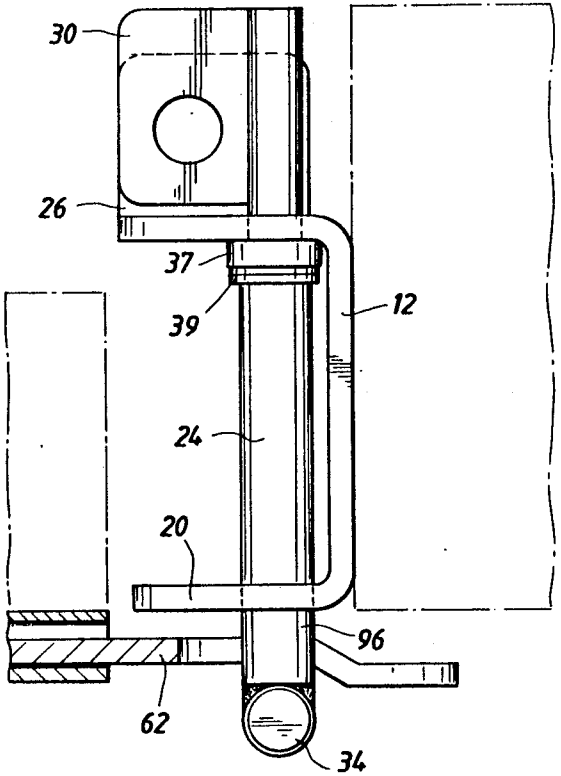

Referring now to the drawings and first to FIG. 1, a double self-latching double-locking gate latch mechanism constructed in accordance with the present invention is illustrated generally at 10 and incorporates a first latch bracket 12 defining at least two mounting apertures as shown at 14 and 16 that may be of elongate configuration as shown to allow vertical adjustment of the latch bracket 12 relative to a gate post or other structure such as is shown in broken lines at 18. Alternatively, the mounting apertures 14 and 16 may be simple drilled holes if vertical adjustment of the latch bracket is not required. The bracket 12 is provided with opposed transversely projecting integral flanges 20 and 22 that are typically formed by stamping the bracket from relatively thick sheet metal. The flanges 20 and 22 provide registering openings to provide rotatable support for a rotatable latch element 24. From the bracket flange 22 projects a laterally extending integral flange 26 that forms a transversely extending lock projection or locking element which defines a lock opening 28. At one of its extremities the rotatable latch element is provided with the transverse lock member 30 in the form of a locking plate which also defines a lock opening 32 which, in the latched position of the rotatable latch element 24, is positioned in registry in lock opening 28 by virtue of the juxtaposition of the locking element 26 and the locking member 30. Thus, when the rotatable locking element is disposed at its latched position as shown in FIGS. 1 and 4 the shackle of a padlock may be extended through the registering lock openings 28 and 32 thus securing the plate members 26 and 30 against relative unlocking movement.

At its opposite end the rotatable latch element is provided with a latch retainer which, in the embodiment illustrated in the drawings, may conveniently take the form of an elongate head or T-head member 34 which is oriented at substantially 90° relative to the transverse lock member 30. The function of the elongate retainer head 34 will be described in detail hereinbelow.

Figure 4:
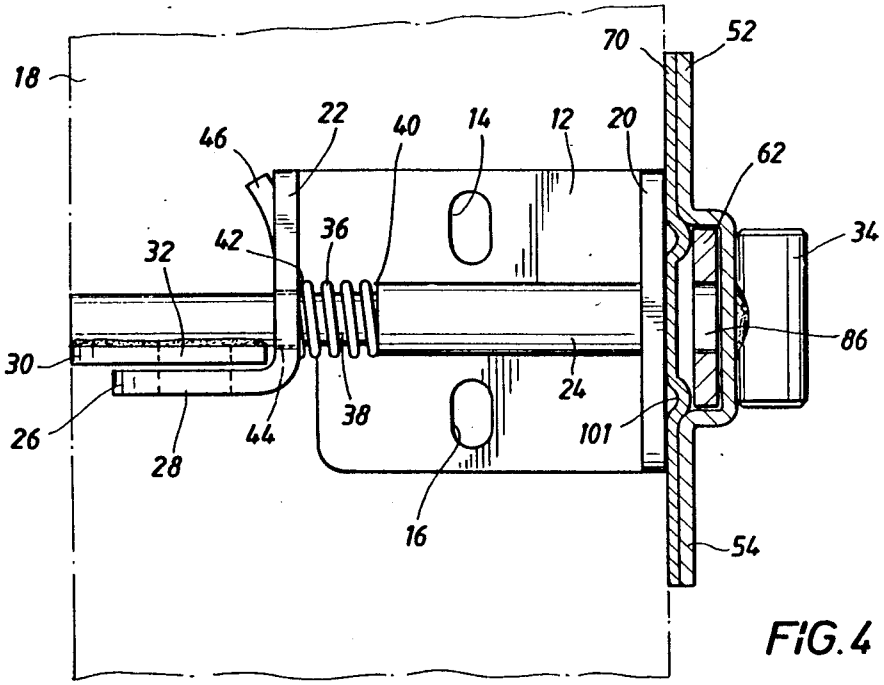

The rotatable latch element is provided with a torsion spring 36 which is received about a reduced diameter portion 38 thereof with one end 40 of the spring being secured in non-rotatable relation to the rotatable latch element 24 while the opposite end 42 thereof is positioned in non-rotatable relation with the flange 22 The torsion spring provides an urging force that automatically urges the rotatable latch element 24 to its latched position bringing the locking plates 26 and 30 into juxtaposition as shown in FIG. 4. Thus, after the rotatable latch element has been rotated to its unlatched position against the force of the torsion spring 36 either by rotation of the locking member 30 or the transverse T-head 34, upon release the latch element 24 is automatically repositioned to its latched position by the force of the torsion spring. If desired, latching movement of the rotatable latch element may be retarded by frictional resistance at the shaft opening 44 or at both shaft openings of the flanges so that the latch element 24 will remain at its unlatched position. Upon the force of gate closure this frictional force is overcome, thereby allowing the torsion spring to automatically rotate the latch 24 to its latched position as shown in FIG. 4. An upper portion of the transverse flange 22 may be punched out to form a stop projection 46 having the capability of limiting rotation of the rotatable latch element 24 to approximately 90° so that 90° rotation of the elongate T-head 34 at the opposite end of the latch element 24 will be in registry with an elongate slot of a latch slide as will be discussed hereinbelow for unlatching of the gate latch mechanism.

As shown n FIG. 5, the rotatable latch element 24 of an alternative embodiment of this invention may be provided with a friction disc 37, typically composed of a polymer material, which may be secured by a roll pin 39 or other suitable retainer. The roll pin is received in tight friction fitting engagement within a transverse bore formed in the latch element 24 as shown.

A second latch bracket is provided as shown at 50 particularly in FIG. 1. The latch bracket 50 is provided with opposed mounting flanges 52 and 54 each being provided with elongate mounting apertures 56 and 58 to adjustably receive mounting screws or bolts which permit significant vertical adjustment of the bracket 50 to compensate for gate sagging or other causes of latch misalignment that may occur. The latch bracket 50 defines an elongate internal chamber or passage 60 within which is received an elongate latch slide member 62. The latch slide is also generally formed of stamped sheet metal, though such is not intended to be limiting as to the spirit and scope of this invention. The latch slide defines an elongate spring receptacle 64 within which is located a compression spring 66 having one of its ends in force transmitting engagement with an end surface 68 of the elongate spring receptacle or slot 64 for imparting spring force to the latch slide. The second latch bracket 50 is also provided with a rear plate 70 that is punched out to form a spring stop 72 against which the opposite end of the compression spring 66 is seated. At one of its free ends, the latch slide 62 defines an integral transversely projecting plate 74 which defines a lock opening 76 which, in the latched position of the latch slide, is disposed in juxtaposition with a transversely extending locking projection 78 that is integral with the latch bracket 50 and provides a latch opening 80. In the latched position of the latch slide 62 as shown in FIG. 1, the shackle of a padlock may be extended through the registered lock openings 76 and 80 to lock the latch slide against linear movement.

At its opposite end, the latch slide 62 forms a bifurcated extremity having opposed bifurcations 82 and 84 that define an elongate slot 86 therebetween. The width of the opposed side surfaces 88 and 90 that define the elongate slot 86 is slightly greater than the outer dimension of the elongate rotary latch element and slightly greater than the width of the elongate T-head 34. Thus, when the T-head 34 oriented 9° from the position shown in FIG. 2, its unlatched position, the elongate T-head 34 will be positioned to permit lateral movement of the slide latch which occurs upon opening of the gate.

Figure 3:
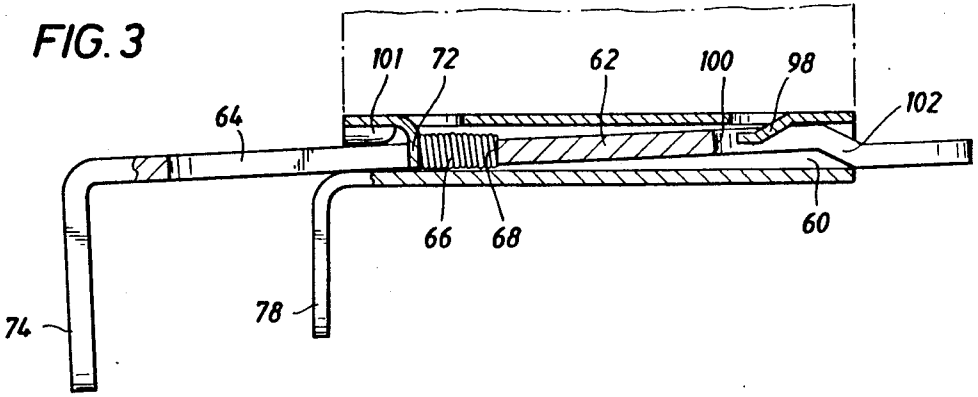

As mentioned above, the slide latch 62 is also capable of linear movement between its extended position as shown in FIGS. 1 and 2 and its retracted position as shown in FIG. 3. At its retracted position the bifurcations 82 and 84 will be moved sufficiently to the left as shown in FIG. 3 and as shown in broken lines in FIG. 2 that the ends of the bifurcations clear the T-head retainer element. In this retracted position the gate may be opened even though the T-head retainer element remains in its latched position as shown in full line in FIG. 2 the bifurcations are also provided with diverging surfaces 92 and 94 that function to guide the slide latch should it be slightly misaligned relative to the cylindrical latch receiving portion 96 of the rotatable latch element.

It is also appropriate to restrain the slide latch 62 against movement from its retracted position and to cause the slide latch to automatically shift to its latched position upon closure of the gate. This feature is accomplished by providing an internal projection 98 that may be punched out from the rear plate 70 and which is disposed for restraining contact with a stop shoulder 100 defined at the innermost end of the elongate slot 86 of the slide latch. As shown in FIG. 3, the internal chamber 60 of the bracket 50 is of sufficient transverse dimension as so permit angulation of the slide latch. Additionally, the bifurcated end of the slide latch is provided with an offset as shown at 102 such that when the slide latch reaches the position shown in FIG. 3, its bifurcated extremity is forced laterally so that slide latch becomes angulated within the chamber 60 and the shoulder 100 comes into registry with the restraining element 98. Internally projecting bosses 101 formed from the rear plate assist in angulated orientation of the latch slide at its retracted position. Releasing the slide latch from the position shown in FIG. 3 causes the compression spring 66 to urge the slide latch forwardly, thereby bringing stop surface 100 into restraining engagement with the internal projection 98. When the gate is closed, the bifurcated extremity of the slide latch will engage the flange 20 of the first latch bracket 12 thereby applying a lateral force that shifts the latch slide to its released position. When this occurs, the compression spring 66 will quickly shift the latch slide to its extended or latched position, bringing the transverse projections 74 and 78 into locking juxtaposition.

OPERATION

In its locked position as shown in FIGS. 1, 2 and 4, a pair of padlocks will be employed with the shackles thereof extending through the registering lock openings 28–32 and 76–80 with the padlocks being located on opposite sides of the gate. In one case, with the opposite padlock remaining in place, a padlock may be removed to unlock the assembled locking plates 26 and 30. After this has been accomplished, the locking plate 30 may be rotated 90° into engagement with the laterally extending stop 46 thereby rotating the rotatable latching element 24 to a position that rotates the transverse latch retainer 34 to a position in registry with the elongate slot 86 of the latch slide. After this has occurred, the gate may be opened with the latch slide in its latched position. Upon closure of the gate, the rotatable latch element is either rotated manually or automatically by the torsion spring 36 again moving the transverse lock member 30 to its locked position as shown in FIG. 4. The padlock may be replaced to lock the rotatable latch element against rotation and to secure the transverse latch retainer 34 at its latched position as shown in FIGS. 1, 2 and 4.

When it is desired to open the gate from the opposite side, the opposite padlock will be unlocked and removed from registered lock openings 76 and 80. Thereafter the latch slide 62 will be manually moved to the left to its retracted position as shown in FIG. 3, at which position it may be restrained in the manner shown in FIG. 3 with the slide latch being angulated by cooperative interaction of the offset 102 of the slide latch and the internal slide latch positioning bosses 101. Upon closure of the gate, the bifurcated end of the slide latch will be subjected to transverse force by its impact with the flange 20 of the first latch bracket, thereby shifting the slide latch laterally within the chamber 60 and releasing the stop shoulder 100 from the internal projection 98 whereupon the latch slide will be moved quickly to its extended or latched position by the force of the compression spring 66. After this automatic latching has taken place the latch mechanism will be in the condition shown in FIG. 1 whereupon the padlock may again be positioned with its shackle extending through the registering lock openings 76 and 80.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A double self-latching double-locking gate latch mechanism for gates:

(a) a first latch bracket for attachment to a first gate member and forming a lock opening to be accessible from one side of said gate;

(b) a rotatable latch element being supported by said first latch bracket for rotatable movement between latched and unlatched positions and forming a lock opening for padlock receiving registry with said lock opening of said first latch bracket, said rotatable latch element defining a latch retainer to be accessible from the other side of said gate, said latch retainer having a latch slide receiving portion and a transversely projecting latching portion forming a length and width;

(c) a second latch bracket for attachment to a second gate member and forming a padlock receiving opening accessible from said other side of said gate, said second latch bracket further forming a latch chamber; and (d) a latch slide being disposed for linear guided movement between extended and retracted positions within said latch chamber and forming a lock opening for registry at said extended position of said latch slide with said padlock receiving opening of said second latch bracket, said latch slide further forming an elongate slot for receiving said rotatable latch element at said extended position of said latch slide, said elongate slot being of greater width than said width of said transversely projecting portion and of less width than the length of said transversely projecting portion, whereby at said latched position of said latch slide, with said lock openings of said latch slide and said second latch bracket in lock receiving registry, said rotatable latch element being rotatably positionable with said latch retainer at a latched position where said transversely projecting latching portion restrains lateral movement of said latch slide relative thereto and an unlatched position where said width of said transversely projecting latching portion is in unlatched registry with said elongate slot of said latch slide.

2. The double self-latching double-locking gate latch mechanism of claim 1, including:

means urging said latch slide toward said latched position thereof.

3. The double self-latching double-locking gate latch mechanism of claim 2, including:

means for restraining said latch slide at said retracted position thereof against the force of said urging means and releasing said latch slide for movement to said extended position by said urging means upon being subjected to predetermined lateral force of said latch slide upon closure of said gate for self-latching thereof.

4. The double self-latching double-locking gate latch mechanism of claim 3, wherein said restraining means comprises:

(a) an internal projection extending from said second latch bracket into said latch chamber; and (b) said latch slide forming a projection engaging portion for establishing restraining engagement with said internal projection at said retracted position of said latch slide, said latch restraining portion being released from said internal projection upon predetermined lateral movement of said latch slide within said latch chamber thus permitting linear movement of said latch slide to said extended position by said urging means.

5. The double self-latching double-locking gate latch mechanism of claim 1, wherein:

said second latch bracket and said latch slide each define lock openings being disposed in padlock receiving registry when said latch slide is located at said extended position thereof.

6. The double self-latching double-locking gate latch mechanism of claim 1, wherein:

said latch slide defines a bifurcated extremity forming said elongate slot, said bifurcated extremity further defining diverging edges forming an entry opening to said elongate slot.

7. The double self-latching double-locking gate latch mechanism of claim 1, wherein:

said latch slide retainer of said rotatable latch element is in the form of an elongate head forming one end of said rotatable latch element and forming said length and width, at said latched position of said rotatable latch element said elongate head being positioned transversely of said elongate slot for restraining said latch slide against lateral movement and at said unlatched position of said rotatable latch element said elongate head being aligned with said elongate slot and thus permitting lateral movement of said latch slide for opening of said gate.

8. The double self-latching double-locking gate latch mechanism of claim 1, wherein:

(a) said first latch bracket forms a lock projection defining said lock opening; and (b) a transverse lock member extending from said rotatable latch element and forming a lock opening, in the latched position of said rotatable latch element said transverse lock member being positioned relative to said lock projection such that said lock receiving openings are positioned in registry for receiving the shackle of a padlock.

9. The double self-latching double-locking gate latch mechanism of claim 8, wherein:

(a) said lock projection of said first latch bracket defines a substantially flat locking plate forming said lock opening; and (b) said transverse lock member of said rotatable latch element being a substantially flat locking plate projecting laterally from said rotatable latch element and, in said latched position of said rotatable latch element being in juxtaposed relation with said locking plate of said first latch bracket with said lock openings disposed in padlock receiving registry.

10. The double self-latching double-locking gate latch mechanism of claim 1, wherein:

(a) said first latch bracket defines a locking element forming said lock opening;

(b) said rotatable latch element defines a lock member oriented for abutting relation with said locking element of said first latch bracket at said latched position of said rotatable latch element and defining a lock opening for registry with said lock opening of said locking element; and (c) said rotatable latch element further defining an elongate head at the end thereof opposite said lock member and forming said latch retainer, said elongate head at said latched position of said rotatable latch element being oriented transversely of said elongate slot of said latch slide thus preventing lateral movement of said latch slide and locking said gate against opening.

11. The double self-latching double-locking gate latch mechanism of claim 10, including:

means urging said latch slide toward said latched position thereof.

12. The double self-latching double-locking gate latch mechanism of claim 11, including:

means for restraining said latch slide at said retracted position thereof against the force of said urging means and releasing said latch slide for movement to said extended position by said urging means upon being subjected to predetermined lateral force of said latch slide upon closure of said gate for self-latching thereof.

13. The double self-latching double-locking gate latch mechanism of claim 12, wherein said restraining means comprises:

(a) an internal projection extending from said second latch bracket into said latch chamber; and (b) said latch slide forming a projection engaging portion for establishing restraining engagement with said internal projection at said retracted position of said latch slide, said latch restraining portion being released from said internal projection upon predetermined lateral movement of said latch slide within said latch chamber thus permitting linear movement of said latch slide to said extended position by said urging means.

14. The double self-latching double-locking gate latch mechanism of claim 1, including:

means rotatably urging said rotatable latch element toward said latched position thereof thus providing said latch retainer with self-latching characteristics upon closing of said gate.

15. The double self-latching double-locking gate latch mechanism of claim 14, wherein:

(a) said rotatable urging means of said rotatable latch element comprises a torsion spring; and (b) said rotatable latch element includes frictional means establishing frictional resistance to rotation of said rotatable latch element relative to said first latch bracket, said frictional resistance means releasing upon application of predetermined axial force to said rotatable latch element upon closure of said gate, thus releasing said rotatable latch element for rotation by said torsion spring to said latched position thereof.

* * * * *